US007594455B2

(12) United States Patent
Swanson et al.

(10) Patent No.: US 7,594,455 B2
(45) Date of Patent: Sep. 29, 2009

(54) FASTENER REMOVING TOOL

(75) Inventors: Daniel C. Swanson, Lombard, IL (US); John J. Apida, St. Charles, IL (US)

(73) Assignee: Sears Brands, LLC, Hoffman Estates, IL (US)

( * ) Notice: Subject to any disclaimer, the term of this patent is extended or adjusted under 35 U.S.C. 154(b) by 21 days.

(21) Appl. No.: 11/877,293

(22) Filed: Oct. 23, 2007

(65) Prior Publication Data

US 2009/0100971 A1 Apr. 23, 2009

(51) Int. Cl.
*B25B 13/50* (2006.01)

(52) U.S. Cl. ..... 81/53.2; 81/411

(58) Field of Classification Search ..... 81/53.2, 81/441, 121.1, 120; 7/158, 165; 408/24, 408/25

See application file for complete search history.

(56) References Cited

U.S. PATENT DOCUMENTS 4,688,315 A * 8/1987 Jannke ..... 81/53.2
6,598,498 B1 7/2003 Pigford et al.
6,877,402 B1 4/2005 Pigford et al.
7,140,087 B1 * 11/2006 Giltner ..... 81/53.2
7,152,509 B2 12/2006 McCalley, Jr. et al.

* cited by examiner

*Primary Examiner*—D. S Meislin
(74) *Attorney, Agent, or Firm*—Gary R. Jarosik

(57) ABSTRACT

A fastener removing tool is provided. The fastener removing tool includes an extractor portion having an inside surface adapted to grip a fastener. The extractor portion further defines an outside surface with a cutting edge is adapted to cut a bore when the tool grips and removes a fastener. The fastener removing tool further includes a main body fixed relative to the extractor portion. The main body is adapted to engage with a driving tool for powering rotation of the fastener removing tool. The fastener removing tool also includes a cutter portion fixed relative to the main body opposite the extractor portion. The cutter portion includes a plurality of cutting members defining a plug forming space therebetween. A formed plug is to be placed into the bore formed during extraction of the fastener.

11 Claims, 4 Drawing Sheets

FASTENER REMOVING TOOL

FIELD

The present disclosure relates to tools which are utilized in removing broken fasteners and repairing resultant holes.

BACKGROUND

Tools for removing broken fasteners are well known. For example, fastener extractors which extend over a fastener to be removed are disclosed in U.S. Pat. No. 6,598,498 to Pigford et al. and U.S. Pat. No. 6,877,402 to Pigford et al. In another example, a fastener extractor which extends into a hole drilled into a faster to be removed is disclosed in U.S. Pat. No. 7,152,509 to McCalley, Jr. et al. Each of these patents is incorporated herein by reference in its entirety.

SUMMARY

The present disclosure provides an improved fastener removing tool. The fastener removing tool includes an extractor portion, a main body, and a cutter portion.

The extractor portion has a generally annular shape with an axis defined therethrough. The extractor portion defines an inside surface adapted to grip and remove a fastener. The extractor portion further defines an outside surface having a cutting edge extending outwardly therefrom. The cutting edge is adapted to cut a bore when the tool grips and removes a fastener.

The main body is fixed relative to the extractor portion. The main body extends away from the extractor portion along the axis and defines an outer coupling surface about the axis. The outer coupling surface is adapted to engage with a driving tool for powering rotation of the fastener removing tool.

The cutter portion is fixed relative to the main body opposite the extractor portion. The cutter portion includes an annular base directly coupled to main body and oriented about the axis. The cutter portion further includes a plurality of cutting members extending axially away from the base. The cutting members define a plug forming space therebetween.

The present disclosure also provides a method of repairing a component having a broken fastener disposed therein. The method includes positioning an extractor end of a fastener removing tool over a broken fastener disposed in an hole of a component. The method further includes gripping and removing the broken fastener from the component while simultaneously cutting a counterbore in the component around the broken fastener. The method also includes cutting a plug with a cutter end of the fastener removing tool. The plug is substantially similar in size to the previously created counterbore. Additionally, the method includes inserting the plug into the hole of the component.

DETAILED DESCRIPTION

Figure 1:
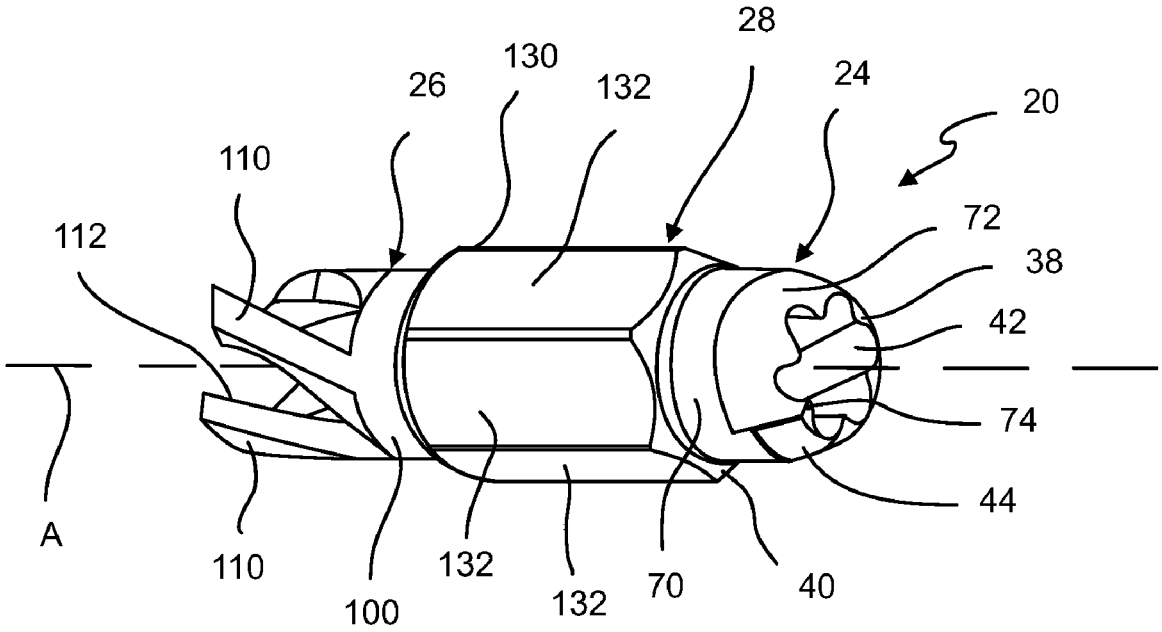
FIG. 1 is a perspective view of an exemplary fastener removing tool according to the principles of the present disclosure.

Referring to FIGS. 1-7, an exemplary fastener removing tool 20 is illustrated in detail. Fastener removing tool 20 extends between a first or extractor end 24 and a second or cutter end 26. Fastener removing tool 20 further includes a main body 28 disposed between extractor and cutter ends 24, 26. According to the principles of the present disclosure, extractor end 24, cutter end 26, and main body 28 are integrally formed. Additionally, fastener removing tool 20 is oriented along an axis A. As used herein, the terms "axial" or "axially" refer to a direction extending along axis A, and the terms "radial" or "radially" refer to directions perpendicular to axis A.

Fastener removing tool 20 is configured such that a driving tool or mechanism, such as a drill or drill press, (not shown) can engage main body 28 to power rotation of fastener removing tool 20 and, therefore, utilize one of extractor end 24 and cutter end 26. In particular, both extractor end 24 and cutter end 26 are operated by rotation about axis A. In operation, extractor end 24 is configured to grip and remove a fastener disposed in a component, such as a piece of wood, and contemporaneously form a counterbore in the component around the fastener. Cutter end 26 is separately operated to cut a plug sized to fit into the counterbore formed while removing a fastener.

Figure 2:
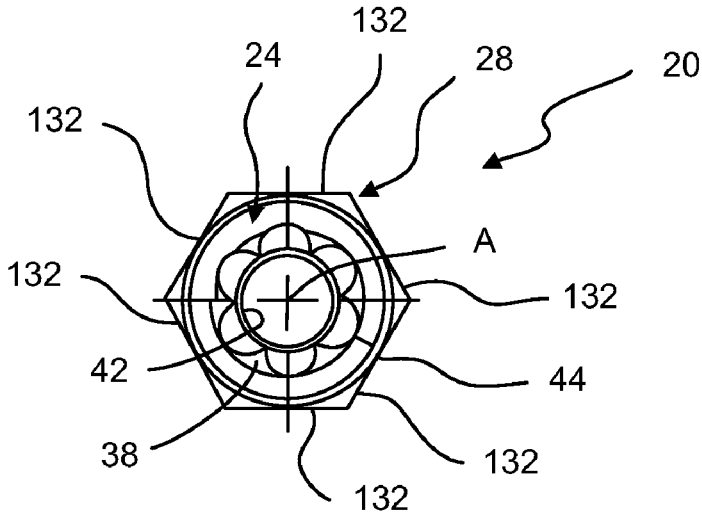
FIG. 2 is a end view of the fastener removing tool of FIG. 1.

Referring in particular to FIGS. 1-2, extractor end 24 is illustrated in detail. Extractor end 24 has a generally cylindrical shape oriented about axis A. Extractor end extends between a first end 38 disposed opposite main body 28 and a second end 40 proximate main body 28. Furthermore, extractor end 24 defines an inside surface 42 and an outside surface 44.

Figure 6:
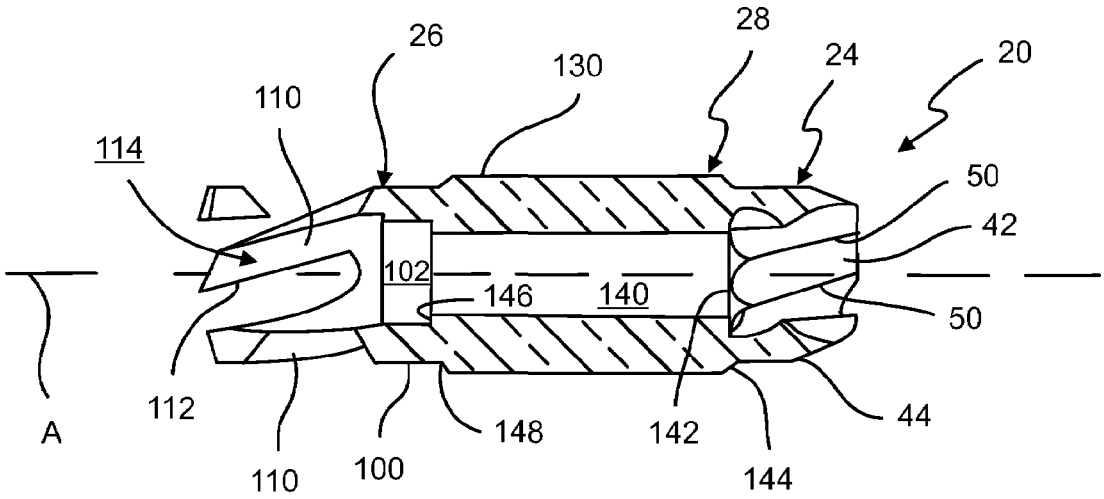
FIG. 6 is a cross-sectional side view of the fastener removing tool of FIG. 1 along the line 6-6 illustrated in FIG. 5.

With additional reference to FIG. 6, inside surface 42 is configured to grip a fastener for removal. Inside surface 42 defines a generally cylindrical aperture through extractor end 24 and about axis A. Furthermore, a plurality of gripping features 50 extending from inside surface 42. As is well known in the art, gripping features 50 are oriented so as to secure a fastener relative to tool 20 as tool 20 rotates in a loosening direction for the fastener. For example, if the fastener has right-hand thread, tool 20 is configured to grip and secure the fastener while rotating in the counterclockwise direction.

Figure 7:
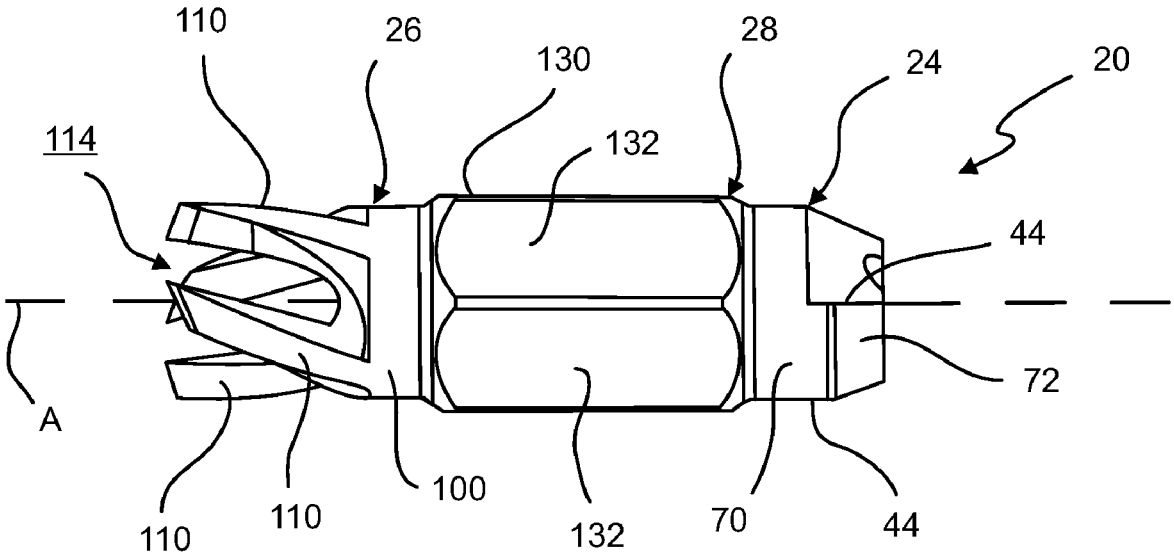
FIG. 7 is another side view of the fastener removing tool of FIG. 1.

Referring also to FIG. 7, outside surface 44 also defines a generally cylindrical shape about axis A. Outside surface 44 includes a main section 70 disposed proximate main body 28 and a sloped section 72 extending between first end 38 and main section 70. Sloped section 72 is oriented so as to extend radially outwardly from first end 38 to main section 70. Outer surface 44 further includes a boring edge 74 extending radially outwardly from sloped section 72. Boring edge 74 is configured to face the loosening direction for the fastener configured to be removed by tool 20. Accordingly, when fastener removing tool 20 rotates in the loosening direction, boring edge 74 operates to form a counterbore in the component in which the fastener is disposed.

Figure 3:
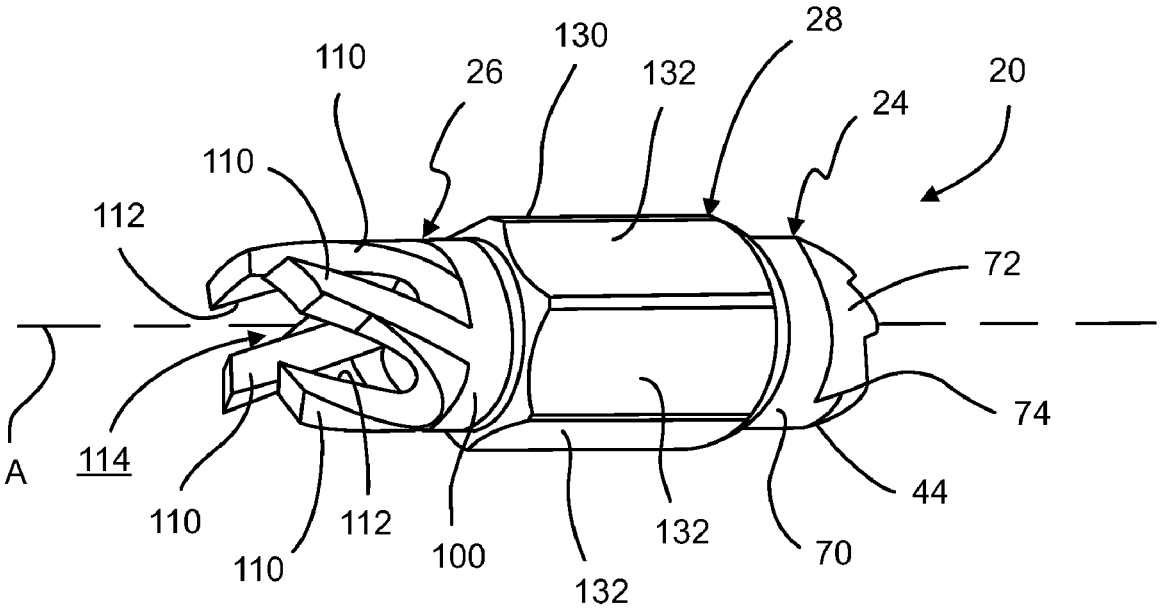
FIG. 3 is another perspective view of the fastener removing tool of FIG. 1.
Figure 4:
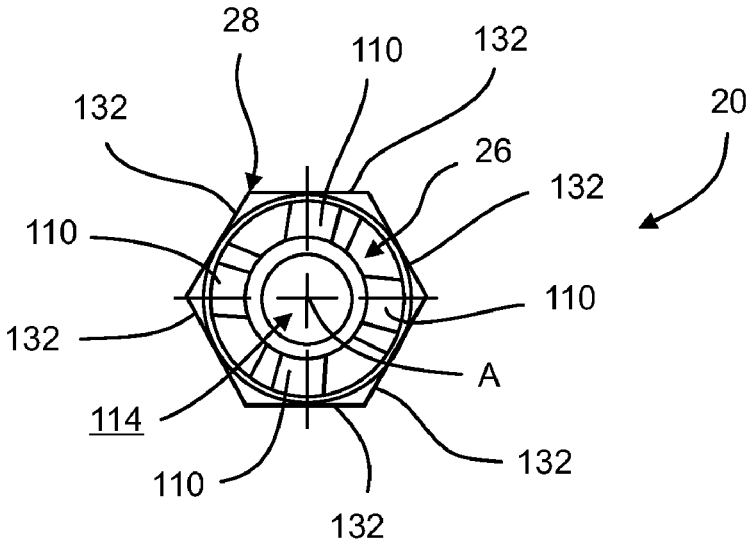
FIG. 4 is another end view of the fastener removing tool of FIG. 1.
Figure 5:
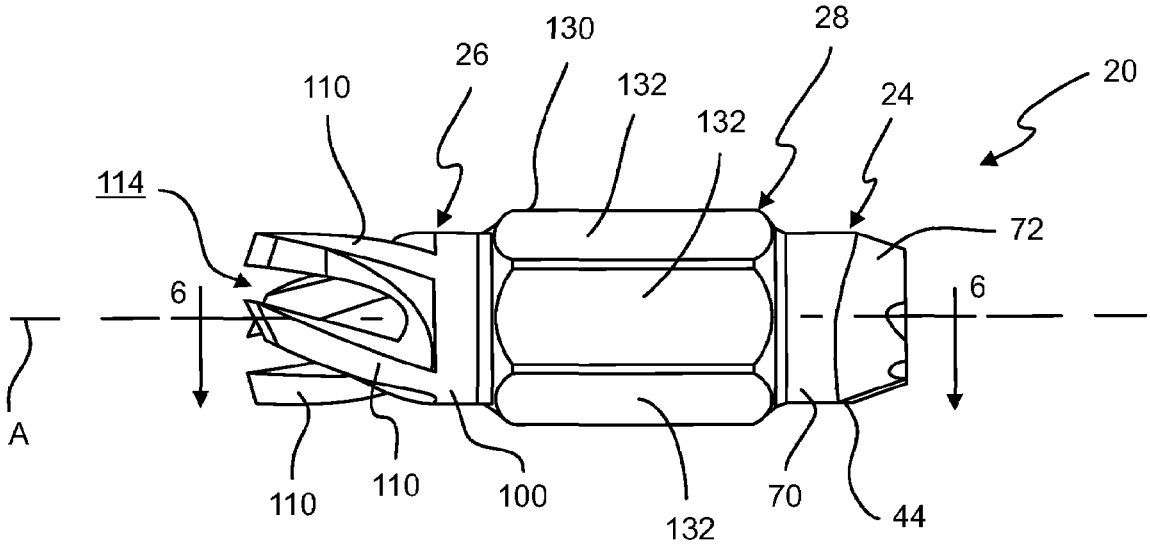
FIG. 5 is a side view of the fastener removing tool of FIG. 1.

Referring in particular to FIG. 3-4, cutter end 26 is illustrated in detail. Cutter end 26 includes an annular base 100 proximate main body 28. Base 100 defines a generally cylindrical aperture 102 (FIG. 6) oriented about axis A. Additionally, base 100 has a substantially similar size to main section 70 of outer surface 44 of extractor end 24.

Cutter end 26 further includes a plurality of cutting members 110 extending axially from base 100. In particular, exemplary tool 20 includes four cutting members 110. Cutting members 110 are all shaped to be substantially similar or the same. Furthermore, cutting members 110 are each curved around axis A in a right-hand direction, and each of cutting members 110 define a cutting edge 112.

Cutting members 110 are spaced apart about axis A. Moreover, a plug space 114 is defined between cutting members 110. Plug space 114 determines the size of the plug created through operation of cutter end 26. According to the principles of the present disclosure, cutter end 26 is configured such that plug space 114 corresponds with the size of the counterbore to be created through use of extractor end 24.

Referring again to FIGS. 1-7, main body 28 defines an outer surface 130 having a plurality of adjacent, relatively flat coupling sections 132. In particular, exemplary fastener removing tool 20 includes outer surface 130 having a hexagonal cross section and, thus, six coupling portions 132. Outer surface 130 is configured for fastener removing tool 20 to engage with another tool, such as a driver, to power rotation of tool 20. Exemplary fastener removing tool 20 includes outer surface 130 extending radially outside of extractor end 24 and cutter end 26. Accordingly, another tool, such as a driver, can extend over one of extractor end 24 and cutter end 26 to utilize the other of extractor end 24 and cutter end 26.

With particular reference to FIG. 6, main body 28 includes a generally cylindrical aperture 140 extending therethrough and about axis A. Aperture 140 is generally smaller in size to both inside surface 42 of extractor end 24 and aperture 102 of cutter end 26. With inside surface 42 of extractor end 24 being larger than aperture 140, and with outer surface 130 extending radially outside of extractor end 24, main body 28 defines an inner ledge 142 and an outer ledge 144 proximate extractor end 24. Similarly, with aperture 102 of cutter end 26 being larger than aperture 140, and with outer surface 130 extending radially outside of extractor end 24, main body defines an inner ledge 146 and an outer ledge 148 proximate cutter end 26.

The present disclosure can vary in many ways. The components of a fastener removing tool according to the principles of the present disclosure can vary in relative size and orientation. Furthermore, the various components can vary in configuration without causing the tool to depart from the principles described above. Accordingly, it is to be understood that the present disclosure is merely exemplary in nature.

What is claimed is:

1. A fastener removing tool comprising:

an extractor portion having a generally annular shape with an axis defined therethrough, said extractor portion defining an inside surface adapted to grip a fastener, said extractor portion further defining an outside surface having a cutting edge extending outwardly therefrom, said cutting edge adapted to cut a bore when the tool grips a fastener for removal;

a main body fixed relative to said extractor portion and extending away from said extractor portion along said axis, said main body defining an outer coupling surface about said axis, said outer coupling surface being adapted to be engaged by a driving tool for powering rotation of the tool; and a cutter portion fixed relative to said main body opposite said extractor portion, said cutter portion including an annular base directly coupled to said main body and oriented about said axis, said cutter portion further including a plurality of cutting members extending axially away from said base, said cutting members defining a plug forming space therebetween.

2. The fastener removing tool of claim 1, wherein said extractor portion defines an end opposite said main body, said outside surface of said extractor portion defining a main section proximate said main body and a sloped section extending radially outwardly from said end to said main section.

3. The fastener removing tool of claim 2, wherein said cutting edge extends outwardly from said sloped section of said outside surface.

4. The fastener removing tool of claim 2, wherein said main section of said extractor portion and said annular base of said cutter portion are substantially similar in size.

5. The fastener removing tool of claim 1, wherein said cutting members are spaced apart about said axis.

6. The fastener removing tool of claim 5, wherein said cutter portion includes four cutting members.

7. The fastener removing tool of claim 1, wherein said outer coupling surface defines a plurality of adjacent couplings sections about said axis.

8. The fastener removing tool of claim 7, wherein said outer coupling surface defines six adjacent coupling sections about said axis.

9. The fastener removing tool of claim 1, wherein said plug space forms a plug similar in size to said bore formed by said extractor end.

10. The fastener removing tool of claim 1, wherein said main body radially extends outside of said of said extractor portion and said cutter portion.

11. The fastener removing tool of claim 1, wherein said main body has a generally cylindrical aperture extending therethrough, said aperture being oriented about said axis.

* * * * *